US007491314B2

(12) United States Patent
Van Den Bosch et al.

(10) Patent No.: US 7,491,314 B2
(45) Date of Patent: Feb. 17, 2009

(54) PROCESS TO PRODUCE PIPELINE-TRANSPORTABLE CRUDE OIL FROM FEED STOCKS CONTAINING HEAVY HYDROCARBONS

(75) Inventors: Petrus Johannes Walterus Maria Van Den Bosch, Amsterdam (NL); Franciscus Antonius Maria Schrijvers, Amsterdam (NL)

(73) Assignee: Shell Oil Company, Houston, TX (US)

( * ) Notice: Subject to any disclaimer, the term of this patent is extended or adjusted under 35 U.S.C. 154(b) by 340 days.

(21) Appl. No.: 10/561,690

(22) PCT Filed: Jul. 1, 2004

(86) PCT No.: PCT/EP2004/051322

§ 371 (c)(1),
(2), (4) Date: Dec. 22, 2005

(87) PCT Pub. No.: WO2005/003258

PCT Pub. Date: Jan. 13, 2005

(65) Prior Publication Data

US 2006/0144754 A1 Jul. 6, 2006

(30) Foreign Application Priority Data

Jul. 1, 2003 (EP) ..... 03077061

(51) Int. Cl.
*C10G 7/00* (2006.01)
*C10G 9/00* (2006.01)

(52) U.S. Cl. ..... 208/92; 208/86; 208/93; 208/106; 208/251 R; 208/309; 208/321; 208/337; 208/370

(58) Field of Classification Search ..... 208/86, 208/92, 93, 106, 251 R, 309, 321, 337, 370
See application file for complete search history.

(56) References Cited

U.S. PATENT DOCUMENTS

| | | | | |
|---|---|---|---|---|
| 4,994,172 | A * | 2/1991 | Buchanan et al. | 208/106 |
| 6,096,192 | A | 8/2000 | Myers et al. | 208/108 |
| 6,379,534 | B1 | 4/2002 | Fung et al. | 208/93 |

FOREIGN PATENT DOCUMENTS

| | | |
|---|---|---|
| CA | 2195165 | 7/1997 |
| SU | 1122866 | 11/1984 |
| WO | 98/10036 | 3/1998 |

OTHER PUBLICATIONS

International Search Report dated Sep. 10, 2004 (PCT/EP2004/051322).

* cited by examiner

*Primary Examiner*—Glenn Caldarola
*Assistant Examiner*—Prem C. Singh
(74) *Attorney, Agent, or Firm*—Charles W. Stewart

(57) ABSTRACT

A process for the production of a pipeline-transportable crude oil from a bitumen feed, the process comprising:

(1) dividing the bitumen feed into two fractions, the first fraction comprising between 20 and 80 wt % of the feed, the second fraction comprising between 80 and 20 wt % of the total feed, (the two fraction together forming 100 wt % of the feed), (2) distillation of the first fraction obtained in step (1) (preferably under vacuum) into a light fraction boiling below 380° C. (preferably the 450° C. fraction, more preferably the 510° C. fraction) and a residual fraction;

(3) thermal cracking (of at least part of, preferably all of,) the residual fraction obtained in the distillation process described in step (2);

(4) distillation of the product obtained in step (3) into one or more light fractions (boiling below 350° C.), optionally one or more intermediate fractions (boiling between 350 and 510° C.) and a heavy fraction (boiling above at least 350° C.);

(5) combining the second fraction obtained in step (1), the light fraction obtained in step (2) and the light fraction(s) obtained in step (4) to obtain a pipeline-transportable crude oil; and (6) using heavy fraction obtained in step (4) for the generation of power and/or heat.

11 Claims, 1 Drawing Sheet

PROCESS TO PRODUCE PIPELINE-TRANSPORTABLE CRUDE OIL FROM FEED STOCKS CONTAINING HEAVY HYDROCARBONS

The present application claims priority to European Patent Application No. 03077061.4 filed 01 Jul., 2003.

1. Field of the Invention

The invention relates to a process for the production of a pipeline-transportable crude oil from a bitumen feed, especially a tar sands bitumen, comprising separating the feed into two parts, distillation of one part to obtain a light and a heavy fraction, thermal cracking of the heavy fraction to produce one or more light fractions and one or more heavy fractions, mixing all light fractions and the second part of the feed to obtain a pipeline-transportable crude oil which can be transported over long distance for further treatment in a (standard) refinery, and using the heavy fraction obtained after thermal cracking for the generation of heat and/or power. The bitumen feed is especially crude oil extracted from tar sands.

2. Background of the Invention

Very heavy crude oil deposits, such as the tar sand formations found in places like Canada and Venezuela, contain trillions of barrels of a very heavy, viscous petroleum. This heavy crude oil is referred to in this specification as bitumen. The bitumen has an API gravity (ASTM D 287) typically in the range of from 5° to 10° and a viscosity, at formation temperatures and pressures that may be as high as a million centipoise. The hydrocarbonaceous molecules making up the bitumen are low in hydrogen and have a resin plus asphaltenes content as high as 70%. This makes the bitumen difficult to produce, transport and upgrade. It needs to be diluted with a solvent if it is to be transported by pipeline to an upgrading or other facility as the production location is usually at a considerable distance from the upgrading facility. A process for producing a diluent for transporting the bitumen upgrading facilities by pipeline is disclosed, for example, in U.S. Pat. No. 6,096,192.

Bituminous heavy crudes, e.g. crude oils extracted from tar sands, show relatively low API gravities. This is due to the very high residue (510+° C.) content of the bitumen. The lighter fractions in bituminous heavy crude usually are of a reasonable quality, although often of a lesser quality than lighter fractions derived from the more conventional crudes, e.g. Arabian light or Brent oil. It is the sheer amount of residue that is the main cause for the low API gravity and consequently the high viscosity. This high viscosity results in the impossibility to transport the bitumen feed via pipelines.

Another problem of heavy bituminous crudes concerns the mismatch between the demand of light products and their availability in the crude. Further, from a "standard refinery hardware point of view", the use of heavy bituminous will cause underloading of the part of the refinery that processes the light fractions (e.g. <350° C.) and overloading the part that processes the heavy fractions (e.g. >350° C.). This can be overcome by installing extra residue conversion capacity in the refinery. Another solution could be residue conversion capacity at the source of the crude oil. However, conversion at the source comprises usually "total residue conversion schemes", which render all conversion capacity useless at the receiving end of the crude, i.e. in the existing refinery. Idle conversion capacity is a very unwanted situation, as most of the invested capital has been invested in this very part of the refinery. As mentioned above, it is known to use solvents to transport heavy bituminous crudes, however, the use of the solvents (or diluents), usually implies that the solvent has to be returned to the production place.

A possible solution for the above problem is to separate the heavy bituminous crude into a light and a heavy fraction and to thermally crack (e.g. by means of visbreaking) the heavy fraction after which all liquid products are blended into a "synthetic" crude. This synthetic crude has a lower viscosity and a lower residue (expressed as >510° C.) content. The drawback of such a scheme is that the asphaltenes in the thermally cracked residue have a lower stability, so when blending back the lighter part of the crude into the total liquid product of the thermal cracker, stability problems may occur because of the poor peptizing power (aromaticity or solvency) of these light fractions. This may result in a situation in which only restricted residue conversion is possible, which in its turn will result in insufficient viscosity reduction.

3. SUMMARY OF THE INVENTION

In the present process, now, it is proposed to separate a heavy bituminous feed into two parts, whereafter the first part of the feed is separated into a light fraction and a heavy fraction, which heavy fraction is thermally cracked and separated in a second light fraction and a residual fraction, followed by mixing the two light fractions and the second part of the feed into a pipeline-transportable crude oil, while the thermally cracked heavy fraction is used for the generation of power and/or heat. In this way a minimum upgrading is done at the source of the crude oil. This usually is an advantage, as the source is often in a remote location, often a harsh environment, little infrastructure and restricted availability of skilled labour. Further, by only converting part of the heavy crude, i.e. thermal cracking of the heavy fraction obtained after distillation of part of the feed, a significant part of the feed is untouched, which avoids to a large extent stability problems when blending in light products into untouched heavy bituminous crude. The split between untouched heavy bituminous crude and process crude is such that a pumpable syncrude is produced, which fits much better into the configuration of receiving refineries as well as in the demand barrel of markets in which receiving refineries operate. The power and/or heat generated by conversion of the residual fraction described above very suitably is to be used in the process of the present invention. Depending on the amount of power/heat generated, export may be possible. A very interesting possibility is the generation of electricity for export purposes.

4. BRIEF DESCRIPTION OF THE DRAWINGS

5. DETAILED DESCRIPTION OF THE INVENTION

Figure 1:
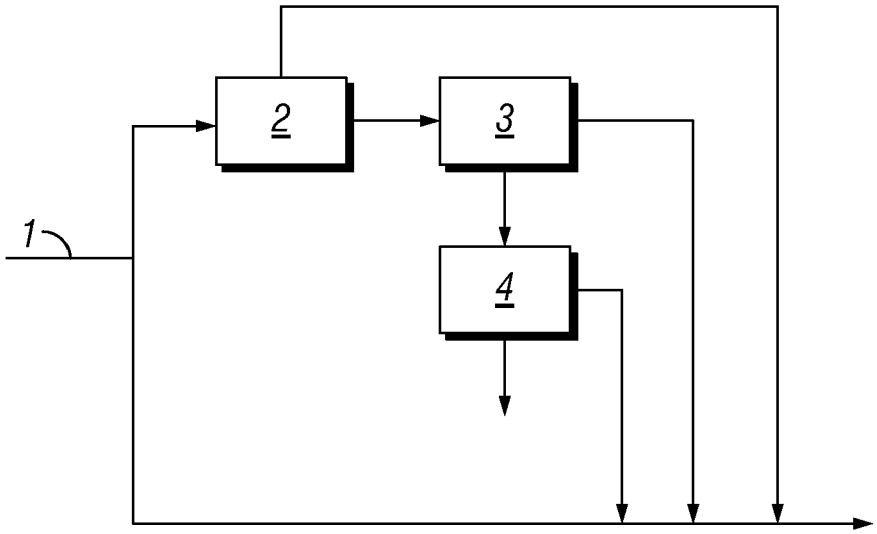
FIG. 1 is a simple block flow diagram for an embodiment of the process for the production of a pipeline-transportable syncrude.

The present invention, now, relates to process for the production of a pipeline-transportable crude oil from a bitumen feed, comprising;

(1) dividing the bitumen feed into two fractions, the first fraction comprising between 20 and 80 wt % of the feed, the second fraction comprising between 80 and 20 wt % of the total feed, (the two fraction together forming 100 wt % of the feed), (2) distillation of the first fraction obtained in step (1) (preferably under vacuum) into a light fraction boiling below 380° C. (preferably the 450−° C. fraction, more preferably the 510−° C. fraction) and a residual fraction, (3) thermal cracking (of at least part of, preferably all of,) the residual fraction obtained in the distillation process described in step (2), (4) distillation of the product obtained in step (3) into one or more light fractions (boiling below 350° C.), optionally one or more intermediate fractions (boiling between 350 and 510° C.) and a heavy fraction (boiling above at least 350° C.), (5) combining the second fraction obtained in step (1), the light fraction obtained in step (2) and the light fraction(s) obtained in step (4) to obtain a pipeline-transportable crude oil, and (6) using heavy fraction obtained in step (4) for the generation of power and/or heat.

The bitumen feed may be described as a heavy bituminous crude. The hydrogen/carbon atomic ratio is suitably between 1.3 and 1.6, usually about 1.4 to 1.5.

The bitumen feed may comprise one single feed stream, but may also comprise several feed streams which are directly used for steps (2) and (5). In that case the feed stream of step (1) is to considered as the total feed stream of the individual streams.

The API gravity is suitably between 10 and 20 (heavy crudes), or, preferably less than 15, more preferably less than 10 (extra heavy crudes and, further especially, tar sands). The viscosity is usually above 10,000 cps at reservoir temperature. These feeds may be produced from oil fields containing such heavy crudes, but suitable sources are shale oil and, especially, tar sands. Tar sands occur in a number of places, notably Northern Canada (Athabasca tar sands) and Venezuela (Orinoco tar sands). A suitable separation between sand and oil may be carried out by hot water extraction (hot water extraction, steam/hot water injection). The amount of asphaltenes in the feed is very high.

The pipeline-transportable crude oil as described may have to be transported over distances up till 1000 km or even above, usually up till 500 km. The viscosity usually will be up till 500 cSt (@ 37.8° C.), preferably up till 250 cSt, more preferably up till 100 cSt.

The division of the total feed into the two fractions is suitably carried out in such a way that the first fraction is as small as possible while still a pipeline-transportable syncrude is obtained. It will be appreciated that the result will depend on the actual composition of the bitumen feed. A suitable division is between 20 and 80 wt % of the total feed for the first fraction, preferably between 30 and 70 wt %, more preferably between 35 and 60 wt %, of the total feed.

Distillation of the first fraction is carried out by conventional means. Atmospheric distillation in combination with vacuum distillation may be used. Also high vacuum flashing technology may be used. The light fraction suitably contains all components boiling below 380° C., preferably al components boiling up till 450° C., more preferably up till 510° C. Using high vacuum flash technology, the light fraction may contain all components boiling up till 600° C.

The thermal cracking may be done by a furnace cracking process, but is preferably a soaker visbreaking process. In the soaker visbreaking process the feed is heated to a temperature suitably between 420 and 490° C., preferably between 440 and 480° C., followed by further conversion in a soaker vessel. The residence time is suitably between 0.5 and 2 hours. The conversion obtained may be between 4 and 14 wt % of the material boiling above 510° C., preferably between 8 and 12 wt %. In the case of furnace cracking the temperature is suitably between 440 and 510° C., preferably between 480 and 500° C., the pressure is suitably between 5 and 50 bar, preferably between 15 and 20 bar and the residence time is suitably between 1 and 15 minutes.

The product of the thermal cracking process is fed to a fractionater, preferably an atmospheric fractionater. Here the product is separated into two or more fractions. The light fraction suitably has a boiling point below 350° C., but up till 380°, or even 410° C. is possible. The heavy fraction may be used for the generation of power and/or heat, or, preferably, is sent to a vacuum distillation unit, preferably a vacuum flash unit. In the latter option an intermediate stream is obtained boiling between the boiling point of the light fraction and suitably at least 450° C., preferably 510° C., more preferably 600° C. The very heavy fraction obtained in this way is used for the generation of power and/or heat. The intermediate fraction may be used as blending component for the pipeline-transportable crude oil.

In another embodiment of the invention the product of the thermal cracking process is first send to vapour liquid cyclone. The vapour product, at least comprising the compounds boiling below 400° C., is then sent to the fractionater in the same way as described above, while the liquid stream is combined with the residual stream of the fractionater.

The pumpable syncrude according to the invention, now, is obtained by mixing the second fraction obtained in step (1), the light fraction obtained in step (2) and the light fraction obtained in step (4). Preferably also any intermediate fractions obtained in step (4) are used in the blending process. This blending process is done by methods well known in the art, e.g. stirred or agitated vessel mixing, using jet mixers or mixing nozzles, line mixing, pump mixing etc.

In a further preferred embodiment of the process, the light fraction obtained is step (4) is hydrotreated. Hydrotreatment may be carried out by means of processes known in the art, especially catalytic hydrogenation processes. Most of the unsaturates, suitably at least 80 wt %, preferably at least 90 wt % are removed. Suitably some nitrogen and some sulphur present in the feed is removed. The removal of the olefins (di-olefins as well as mono-olefins) results in a more stable product.

In another embodiment of the invention the product of the thermal cracking process is first separated into two fractions, especially using a quick separation step, for instance by using a vapour liquid cyclone. The vapour product, at least comprising the compounds boiling below 400° C., or even up till 450° C., is than sent to the fractionater and separated into a light fraction (boiling below 350° C., but up till 380° C., or even 410° C. is possible) and one or more heavier fractions. The light fraction is used for the preparation of the pumpable syncrude, optionally after hydrogenation (see above). Optionally, an intermediate fraction may be obtained boiling between the boiling point of the light fraction and 450° C., or even up to 500° C. Further, a heavy fraction is obtained which is combined with the liquid product obtained in the cyclone separation. The combined stream is sent to a distillation unit, preferably a vacuum flash unit, more especially an isenthalpic vacuum flash unit. A light fraction is obtained boiling up till 520° C., or even up till 600° C. is obtained as well as a residual fraction. The residual fraction is used for the generation of power and/or energy. The light fraction, optionally combined with any intermediate fraction from the fractionator, is sent to a second thermal cracking unit. This may be a furnace cracker or a soaker visbreaking unit, preferably a furnace cracker. The condition used for the thermal cracking unit are a temperature between 440 and 510° C., preferably between 480 and 500° C., and a pressure between 5 and 50 bar, preferably between 15 and 30 bar.

The product of the second thermal cracking unit is sent to the fractionater described above.

The generation of power and/or heat from the residual stream as described above may be done by using equipment and processes well known in the art. For instance reciprocating engines (e.g. steam engines, internal combustion engines), steam turbines, and expansion turbines may be used. See for instance, Perry's Chemical Engineer's Handbook, Sixth Edition, Chapter 9.

The invention further relates to a syncrude obtainable by any of the processes described above.

Referring to FIG. 1, a bitumen feed is split into a first fraction comprising between 25 and 75 wt % of the total feed and a second fraction comprising between 75 and 25 wt % of the total feed. The first fraction is sent to crude distillation unit/high vacuum unit 2, and separated into a 510−° C. fraction and a 510+° C. fraction. The 510+° C. fraction is sent to visbreaking unit 3. The 350+° C. fraction out of the visbreaking unit process is sent to vacuum flash unit 4. The 520+° C. fraction of the product of the vacuum flash unit is used for the generation of power and/or heat. The 510−° C. fraction from the crude distillation unit/high vacuum unit 2, the 350−° C. fraction from visbreaking unit 3, optionally after bulk hydrotreatment to remove olefins and some removal of sulphur and nitrogen in hydrotreatment unit 5, and the 350-520° C. fraction from vacuum flash unit 4 are blended into the second fraction of the feed.

Figure 2:
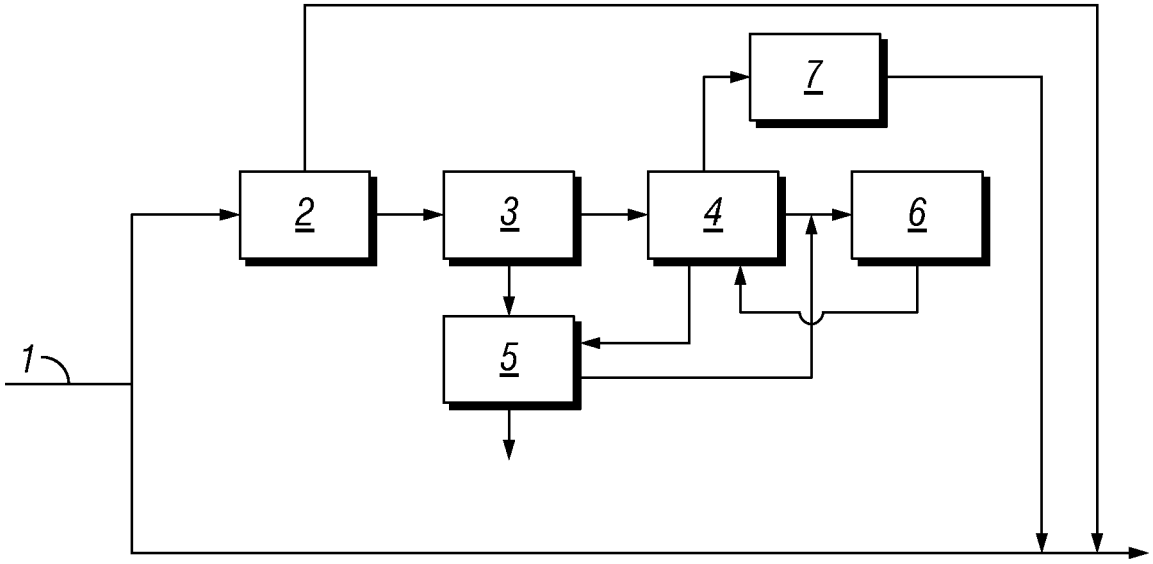
FIG. 2 is another simple block flow diagram for an alternative embodiment of the process for the production of a pipeline-transportable syncrude.

Referring to FIG. 2, a bitumen feed is split into a first fraction comprising between 25 and 75 wt % of the total feed and a second fraction comprising between 75 and 25 wt % of the total feed. The first fraction is sent to crude distillation unit/high vacuum unit 2, and separated into a 510−° C. fraction and a 510+° C. fraction. The 510+° C. fraction is sent to visbreaking unit 3. After quick separation of the product stream of the visbreaking process the 400−° C. fraction is sent to fractionator 4.

The 400+° C. fraction of the visbreaking process is sent to vacuum flash unit 5. The residual fraction of the vacuum flash unit is used for the generation of power and/or heat. The 400-520° C. fraction of vacuum flash unit 5, together with the 350-500° C. fraction from fractionator 4 is sent to high severity thermal cracking unit 6. the converted product from high severity thermal cracking unit 6 is sent to fractionator 4. The bottom fraction of fractionator 4 is sent to vacuum flash unit 5. The 510− fraction of crude distillation unit/high vacuum unit 2, together with the 350−° C. fraction of fractionator 4, optionally after bulk hydrotreatment to remove olefins and some removal of sulphur and nitrogen in hydrotreatment unit 7, are blended into the second fraction of the feed.

That which is claimed is:

1. A process for the production of a pipeline-transportable crude oil from a bitumen feed, the process comprising;

(1) dividing the bitumen feed into two fractions, the first fraction comprising between 20 and 80 wt % of the feed, the second fraction comprising between 80 and 20 wt % of the total feed, the two fractions together forming 100 wt % of the feed;

(2) distilling of the first fraction obtained in step (1) into a light fraction boiling below 380° C. and a residual fraction;

(3) thermal cracking of at least part of the residual fraction obtained in the distillation process described in step (2);

(4) distilling of the product obtained in step (3) into one or more light fraction(s) boiling below 350° C., optionally one or more intermediate fractions boiling between 350 and 510° C. and a heavy fraction boiling above at least 350° C.;

(5) combining the second fraction obtained in step (1), the light fraction obtained in step (2) and the light fraction(s) obtained in step (4) to obtain a pipeline-transportable crude oil; and, (6) using the heavy fraction obtained in step (4) for the generation of power and/or heat.

2. The process according to claim 1, in which the bitumen feed in step (1) is divided into two fractions, the first fraction comprising between 40 and 60 wt % of the feed and the second fraction comprising between 60 and 40 wt % of the total feed.

3. The process according to claim 2, in which the thermally cracked product is split by distillation into a light fraction boiling below 350° C., an intermediate fraction boiling between 350 and 510° C. and a heavy fraction boiling above 510° C.

4. The process according to claim 3, in which at least part of the intermediate fraction is also added to the pipeline-transportable crude oil of step (5).

5. The process according to claim 4, in which the intermediate fraction is thermally cracked, followed by distillation into a light product and a heavy product, the light product being added to the pipeline-transportable crude oil mentioned in step (5), and the heavy product being used in the generation of power and/or heat as described in step (6).

6. The process according to claim 1, in which the thermal cracking in step (3) is carried out at a temperature between 440 and 510° C. and a pressure between 5 and 50 bara.

7. The process according to claim 1, in which the thermal cracking in step (3) is carried out in a soaker vessel.

8. The process according to claim 7, in which the thermal cracking is carried out at a temperature between 420 and 500° C. and a pressure between 2 and 20 bara.

9. The process according to claim 1 in which the first fraction obtained in step (1) is distilled unto a light fraction boiling below 450° C. and a residual fraction.

10. The process according to claim 2 in which the first fraction obtained in step (1) is distilled unto a light fraction boiling below 510° C. and a residual fraction.

11. The process according to claim 3 in which all of the intermediate fraction is added to the pipeline-transportable crude oil of step (5).

* * * * *